US006105286A

United States Patent [19]

Ching et al.

[11] Patent Number: 6,105,286

[45] Date of Patent: Aug. 22, 2000

[54] DEVICE FOR IRONING WITH BYPASS FOR SELFCLEANING

[75] Inventors: Boon K. Ching; Kam W. Choy; Lid J. Lim; Kai H. Kwok, all of Singapore, Singapore

[73] Assignee: U.S. Philips Corporation, New York, N.Y.

[21] Appl. No.: 09/257,653

[22] Filed: Feb. 25, 1999

[30] Foreign Application Priority Data

Mar. 4, 1998 [SG] Singapore ..... 9800484-9

[51] Int. Cl.[7] ..... D06F 75/18

[52] U.S. Cl. ..... 38/77.83

[58] Field of Search ..... 38/77.7, 77.8, 38/77.83, 77.1; 219/245, 254

[56] References Cited

U.S. PATENT DOCUMENTS 3,823,498 7/1974 Davidson et al. ..... 38/77.83
3,983,644 10/1976 Gowdy ..... 38/77.83
4,017,988 4/1977 Coggiola ..... 38/77.83
4,130,954 12/1978 Walker ..... 38/77.83
5,829,175 11/1998 Marchetti et al. ..... 38/77.8
5,924,224 7/1999 Demuth et al. ..... 38/77.8

*Primary Examiner*—Ismael Izaguirre
*Attorney, Agent, or Firm*—Ernestine C. Bartlett

[57] ABSTRACT

A device for ironing laundry having a regulating device and a drip-stop valve arranged in series in a passageway between the water tank and the steam chamber for supplying cold water to the steam chamber for normal steaming operation and a bypass which bypasses the drip-stop valve and in which a valve is arranged for supplying a large amount of cold water directly to the steam chamber for cleaning the steam chamber. For an effective cleaning the location where cold water for cleaning the steam chamber is supplied to the steam chamber is substantially the same as the location where cold water for normal steaming operation during ironing is supplied to the steam chamber.

8 Claims, 3 Drawing Sheets

DEVICE FOR IRONING WITH BYPASS FOR SELFCLEANING

BACKGROUND OF THE INVENTION

The invention relates to a device for ironing laundry comprising a water tank, a steam chamber, a soleplate provided with steam outlet ports, means for heating the soleplate and the steam chamber, a passageway between the water tank and the steam chamber for supplying cold water from the water tank to the steam chamber, a device for regulating the water flow through said passageway, a drip-stop valve arranged in said passageway, which valve opens above a certain temperature and closes below said temperature, said regulating device and said drip-stop valve being arranged in series in said passageway, and a bypass which bypasses the drip-stop valve and in which a valve is arranged for supplying a large amount of water directly to the steam chamber for cleaning the steam chamber, thereby bypassing the drip-stop valve.

Such a device is known from Philips' steam iron 'Azur', marketed since 1993. In this known ironing device the regulating device, which often is a metering valve, can be set by the user to obtain a certain water flow rate from the water tank to the steam chamber. In the steam chamber the water evaporates and the generated steam expels through the steam outlet ports in the soleplate, thereby improving the ironing performance. So, the metering or regulating device controls the steaming rate. In order to avoid having cold water enter the steam chamber while the temperature of the steam chamber is too low to generate steam, a so-called drip-stop valve is arranged in the passageway between the water tank and the steam chamber. This drip-stop valve is arranged in series with the metering valve. Opening and closing of the drip-stop valve depends upon the temperature of the steam chamber. If the temperature of the soleplate is too low to generate a sufficient amount of steam, the drip-stop valve is closed, so that no water can enter the steam chamber. If this temperature is high enough, the drip-stop valve opens. The amount of water dripping into the steam chamber depends upon the setting of the metering valve.

A problem with ironing devices is the proper cleaning of the steam chamber. It is well known that in hard water areas a layer of scale (generally calcium carbonate) will be built up on the inner surfaces of the steam chamber. Scale layers deteriorate the heat transfer to the steam chamber. Therefore, it is desirable for a user to have a possibility to remove the scale layer. Preferably, the ironing device should have a so-called self-clean function. For that purpose, the above described steam iron comprises a bypass which bypasses the drip-stop valve and in which a valve is arranged for supplying water directly to the steam chamber, thereby bypassing the drip-stop valve. With this construction it is possible for the user to open the self-clean valve to suddenly introduce a large amount of water into the steam chamber, thereby performing a self-clean action. The walls of the steam chamber are still hot, so that the large amount of cold water causes a kind of thermal shock effect on the walls, resulting in the layer of scale being cracked and breaking it into small particles which, subsequently, can be rinsed away through the steam outlet ports. This cleaning action can be repeated several times, whereby re-heating the steam chamber might be necessary, because introducing a large amount of cold water into the steam chamber causes a temperature drop of the wall of the steam chamber. In practice, it appears that scale is not removed properly from the walls, especially at the location where a thick layer of scale has been built up, i.e. where water enters the steam chamber for generating steam. The reason for this is that in the mentioned prior art steam iron water, for cleaning the steam chamber, has already been raised in temperature before it reaches said location of scale and is therefore less effective in cracking the layer of scale.

SUMMARY OF THE INVENTION

It is an object of the invention to improve cleaning of the steam chamber of the above described ironing device.

According to the invention the device for ironing laundry is characterized in that means are provided by which the location where cold water for cleaning the steam chamber is supplied to the steam chamber is substantially the same as the location as where cold water for normal steaming operation during ironing is supplied to the steam chamber.

This means that for cleaning the steam chamber a large amount of cold water is supplied to the steam chamber at the very location where a thick layer of scale has been built up, i.e. a wall of the steam chamber underneath the regulating valve. The thermal shock causes a good cracking of the layer.

The invention will now be described in more detail, by way of example, with reference to the drawings.

FIG. 1 shows schematically an ironing device according to a first embodiment of the invention.

FIG. 2 shows a steam iron, partly in a cross-sectional view according to FIG. 1. FIG. 3 shows schematically an ironing device according to a second embodiment of the invention.

FIG. 4 shows a steam iron, partly in a cross-sectional view according to FIG. 3.

In the schematic drawing of FIG. 1, which shows a first example, the ironing device comprises a water tank 1, a steam chamber 2 and a soleplate 3. The water tank 1 is connected to the steam chamber 2 by means of a passageway 4. This passageway comprises, in a sequence from the water tank to the steam chamber, a first channel 5, a second channel 6 and a third channel 7. The steam chamber 2 is thermally connected to the soleplate 3. The means for heating the steam chamber and the soleplate comprises a heating element 8. However, heating of the steam chamber and the soleplate could also be obtained by separate heating elements. In the opening 9 between the second channel 6 and the third channel 7 regulating means 10 is arranged for controlling the supply of water from the water tank 1 to the steam chamber 2. The regulating means comprises an adjustable control valve. In the first channel 5 a drip-stop valve 11 is arranged. The drip-stop valve is thermally connected to the steam chamber 2, i.e. to a wall of the steam chamber. This is indicated by a dashed line 12. Below a certain temperature of the steam chamber the drip-stop valve 11 is closed, thereby preventing water from entering the steam chamber while the temperature of the steam chamber is still too low for generating steam. Above said temperature the drip-stop valve is open. Steam generated in the steam chamber is expelled from the ironing device through steam outlet ports 13 provided in the soleplate 3. The ironing device further comprises a bypass 14 in which an valve 15 is arranged. This bypass, is a direct connection between the water tank 1 and the third channel 7 of the passageway 4, downstream of the control valve 10. For cleaning the steam chamber, the user opens the valve 15 fully. A large amount of cold water flows into the steam chamber 2, thereby causing cracks in the layer of scale. Subsequently the cracked scale particles are rinsed away through the outlet steam ports 13. It is also possible that the water tank 1 is a small tank inside the iron, which can be filled from a larger, external water reservoir either by means of gravity or a pump.

Figure 1:
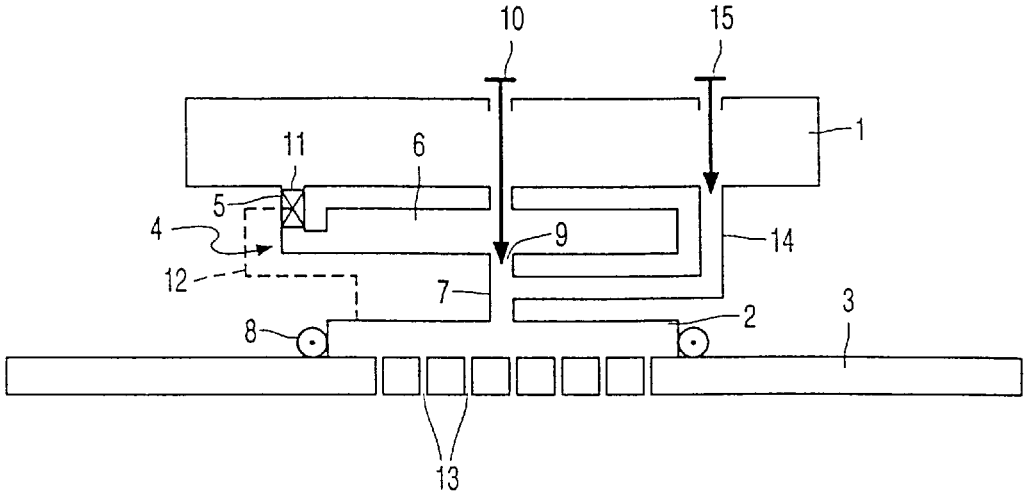
Figure 3:
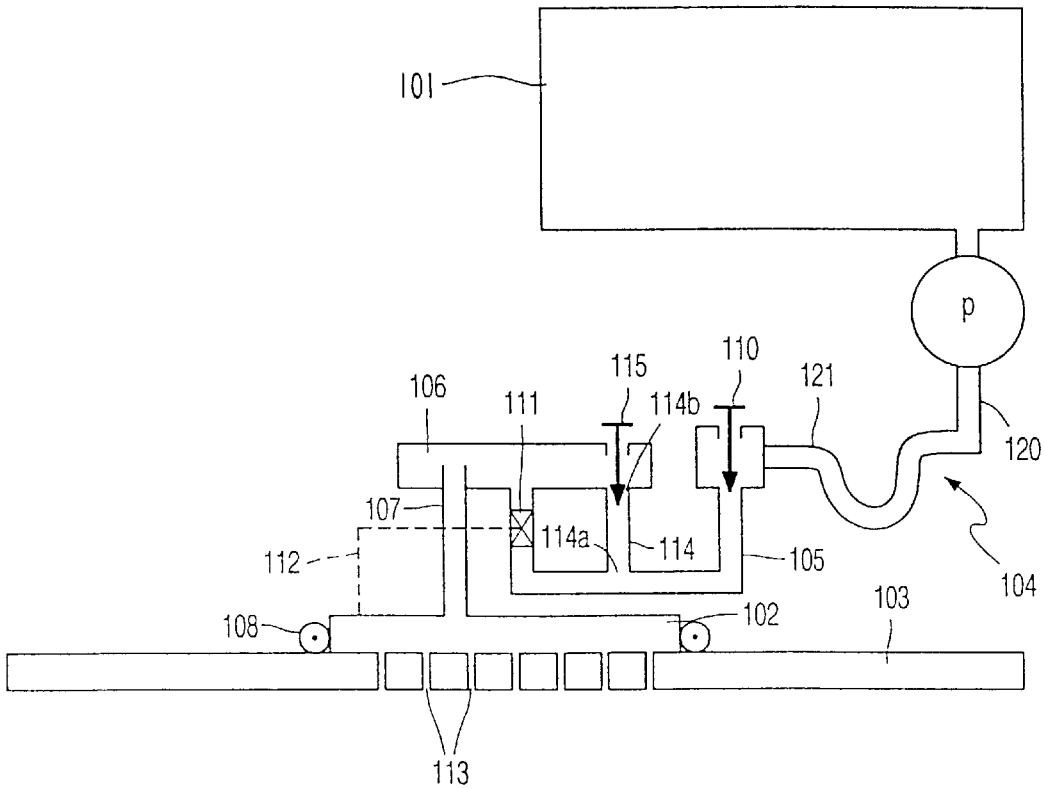
FIG. 3 shows schematically a second example of an ironing device which comprises an external cold water tank 101, which supplies cold water to a steam iron by means of a pump P. The steam iron comprises a steam chamber 102 which is thermally connected to the soleplate 103. For heating the steam chamber and the soleplate the iron comprises a heating element 108, similar to that in the example of FIG. 1. The soleplate comprises a number of outlet ports 113 for the steam, generated in the steam chamber 102. The external water tank 101 is connected to the steam chamber 102 by means of the passageway 104. This passageway 104 comprises, in a sequence from the water tank to the steam chamber, a tube 120, a flexible hose 121, a first channel 105, a second channel 106 and a third channel 107. The pump P is arranged in the tube 120 and usually incorporated in the water tank housing. The flexible hose 121 connects the outlet of the pump P to the steam iron. In the flexible hose, which is a shielded hose, usually a water conduit and an electrical wire for the heating element 108 are arranged. Regulating means 110 in the form of an adjustable control valve is arranged in the first channel 104. By adjusting the valve the user can control the amount of water flowing to the steam chamber 102 and, in this way, the steaming rate. In the second channel 106, which is formed as a small water basin, a drip-stop valve 111 is arranged. The drip-stop valve is thermally connected to the steam chamber 102, i.e. to a wall of the steam chamber. This is indicated by a dashed line 112. Below a certain temperature of the steam chamber the drip-stop valve 111 is closed, thereby preventing water from entering the steam chamber while the temperature of the steam chamber is still too low for generating steam. Above said temperature the drip-stop valve is open. The third channel 107 is an overflow pipe, arranged in the water basin (second channel) 106. This water basin functions as a small reservoir for spraying and/or a so-called shot of steam, which is not further indicated. Between the first channel 105 and the basin 106 a bypass 114 is arranged, which bypasses the drip-stop valve 111. For this purpose, the inlet 114*a* of the bypass is arranged upstream of the drip-stop valve 111 and the outlet 114*b* is arranged downstream of the drip-stop valve. In the outlet 114*b* a valve 115 is arranged. As explained for the above example of FIG. 1, cleaning of the steam chamber can be performed by opening the self-clean valve 115 to introduce a large amount of water into the steam chamber.
Figure 2:
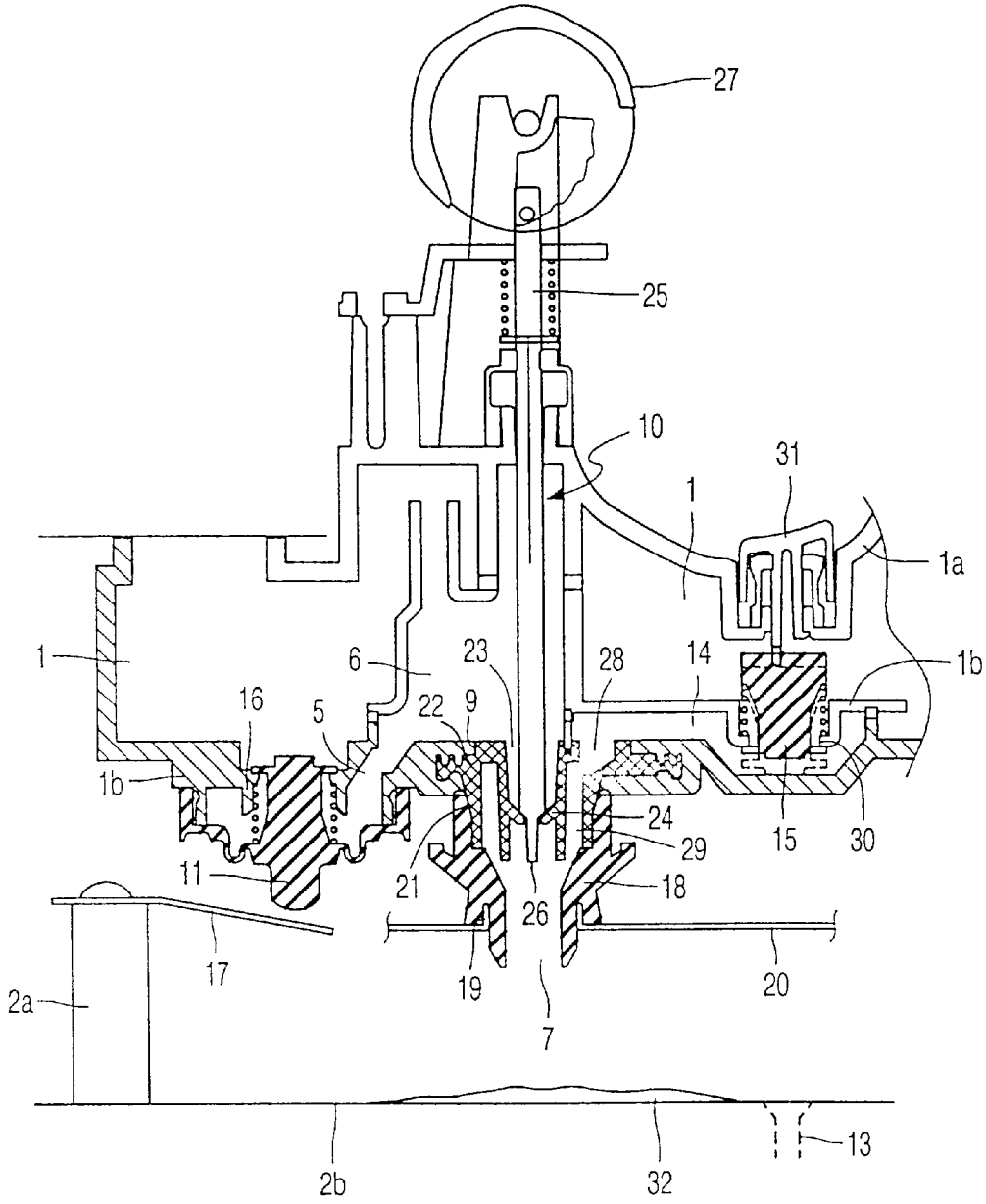
FIG. 2 shows the iron in the schematic drawing of FIG. 1 in a more realistic form and partly in a cross-sectional view. Reference numerals are the same as used in FIG. 1. The drip-stop valve 11 is arranged in an opening 16 in a bottom wall 1*b* of the water tank 1, which opening communicates with the first channel 5. Opening and closing of the drip-stop valve is temperature controlled by a bimetallic element 17 which is thermally connected to a wall 2*a* of the steam chamber 2. When the temperature of the wall 2*a* has reached a certain temperature, e.g. 150–170° C. which is high enough for generating steam, the bimetallic element 17 pushes the valve 11 upwards, thereby opening the valve. Water enters into the first channel 5, from which it flows into the second channel 6. The third channel 7 is formed by a passage in a socket 18 fitted in an opening 19 of a cover plate 20 of the steam chamber 2. Between the outlet opening 9 of the second channel 6 and the inlet opening 21 of the socket 18 a sealing member 22 is provided. This sealing member comprises a central channel 23 with a valve seat 24 for cooperation with the regulating means 10. The regulating means comprises a spring-loaded shaft 25 having a steam needle 26 at the end thereof for cooperation with the valve seat 24 in a well known manner. With a control knob 27 the user can move the shaft up or down, thereby controlling the size of the opening of the central channel 23 and thus the steam rate. A bypass 14 connects the water tank 1 directly to the passage in the socket 18. The outlet 28 of the bypass opens into a ring-shaped channel 29 of the sealing member 22 which surrounds the central channel 23. The inlet of the bypass is connected to an opening 30 in the bottom wall 1*b* of the water tank 1. A self clean valve 15 is arranged in the opening 30. The user can open the valve 15 by means of a self-clean knob 31 which is arranged in a top wall 1*a* of the water tank 1 and in line with the valve 15. When the self-clean knob is pushed down (indicated by dashed lines), the valve 15 opens and a large amount of cold water flows through the bypass and via the ring-shaped channel 29 in the sealing member 22 and the passage in the socket 18 into the steam chamber 2, right on to the layer of scale 32 which has been formed on the hot bottom wall 2*b* of the steam chamber. The temperature difference causes cracks in the layer of scale which breaks into small particles which are rinsed away through the steam outlet ports 13.
Figure 4:
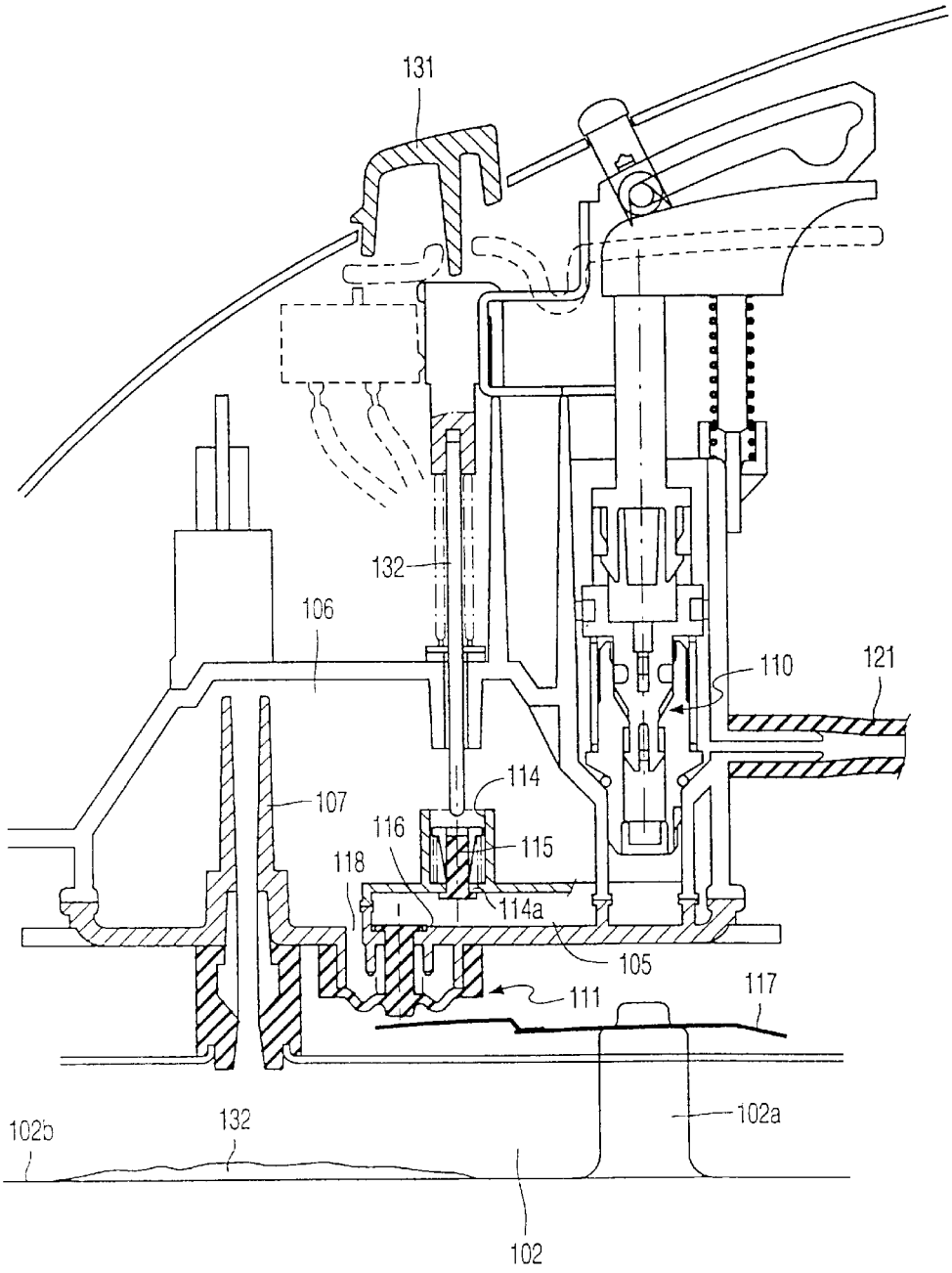
FIG. 4 shows the iron in the schematic drawing of FIG. 3 in a more realistic form and partly in a cross-sectional view. Again the same reference numerals are used as in FIG. 3. Cold water is pumped through the hose 121 to the first channel 105, thus passing through the regulating means 110, which comprises a valve system. The user can control the water flow by means of this valve system. The first channel 105 comprises an opening 116 which communicates with the second channel 106. In said opening 116 the drip-stop valve 111 is arranged. Opening and closing of the drip-stop valve is temperature controlled by means of a bimetallic element 117 which is fastened to a wall 102*a* of the steam chamber 102, similar to that described for the embodiment of FIG. 2. When the drip-stop valve is open, water flows through an aperture 118 to the second channel 106 and from there through the third channel, an overflow pipe 107, to the steam chamber 102. Between the first channel 105 and the second channel 106 there is a bypass 114 in which a valve 115 is arranged. When a layer of scale has been built up on the bottom wall 102*b* of the steam chamber, cleaning is necessary. The valve of the regulating means 110 is fully opened and then a self-clean knob 131 is pushed down. A shaft 132 presses against the valve 115, which opens, thereby introducing a large amount of cold water from the first channel 105 into the second channel and from there through the overflow pipe 107 into the steam chamber. Due to the temperature difference, the layer of scale 132 cracks into small particles, which are rinsed out.

What is claimed is:

1. An ironing device comprising a water tank, a steam chamber, a soleplate provided with steam outlet ports, means for heating the soleplate and the steam chamber, a passageway between the water tank and the steam chamber for supplying cold water from the water tank to the steam chamber, a regulating device for regulating the water flow in said passageway, a drip-stop valve arranged in said passageway, said valve opening above a certain temperature and closing below said temperature, said regulating device and said drip-stop valve being arranged in series in said passageway, and a bypass which bypasses the drip-stop valve and in which a valve is arranged for supplying an amount of water directly to the steam chamber for cleaning the steam chamber, thereby bypassing the drip-stop valve, wherein cold water for cleaning the steam chamber is supplied to the steam chamber at a location that is substantially the same as the location where cold water for normal steaming operation during ironing is supplied to the steam chamber.

2. A device as claimed in claim 1, wherein the passageway comprises a second and a third channel, and the regulating device is located downstream of the drip-stop valve, said regulating device comprising a steam needle, a sealing member between the second and the third channel having a central channel cooperating with said steam needle for adjusting the water flow for normal steaming operation and having a ring-shaped channel surrounding said central channel for cleaning operation, the bypass having an outlet which opens into said ring-shaped channel.

3. A device as claimed in claim 1, wherein the device comprises a pump for pumping cold water into the passageway, said passageway comprising, seen in the direction of the water flow, a first channel in which the regulating means and, downstream thereof, the drip-stop valve are arranged, a second channel and a third channel in the form of an overflow pipe which discharges into the steam chamber, the bypass branching off from the first channel and having an inlet between the regulating means and the drip-stop valve and an outlet ending in the second channel.

4. An ironing device comprising a water tank, a steam chamber, a soleplate provided with steam outlet ports, means for heating the soleplate and the steam chamber, a passageway comprising a first channel, a second channel, and a third channel between the water tank and the steam chamber for supplying cold water from the water tank to the steam chamber, an opening between the second channel and the third channel containing a regulating device for regulating the water flow in said passageway, a drip-stop valve arranged in the first channel of said passageway and thermally connected to the steam chamber, said valve opening above a certain temperature and closing below a certain temperature to prevent water entering the steam chamber when the temperature of the steam chamber is too low for generating steam, and a bypass which bypasses the drip-stop valve and in which a valve is arranged for supplying water directly to the steam chamber for cleaning the steam chamber, thereby bypassing the drip-stop valve, wherein cold water for cleaning the steam chamber is supplied to the steam chamber at a location that is substantially the same as the location where cold water for normal steaming operation during ironing is supplied to the steam chamber.

5. An ironing device as claimed in claim 4, wherein opening and closing of said drip-stop valve is controlled by a bimetallic element.

6. An ironing device as claimed in claim 5 wherein the third channel is formed by a passage in a socket fitted in an opening in a cover plate of the steam chamber.

7. An ironing device as claimed in claim 6, wherein the regulating means comprises an adjustable control valve and a sealing member is provided in an opening of said socket, the sealing member comprising a central channel with a valve seat for cooperation with the control valve of the regulating means, and wherein the regulating means also comprises a shaft which is movable up or down for cooperation with said valve seat, such up or down movement controlling the steam rate by controlling the size of the opening of the central channel of the sealing means.

8. An ironing device as claimed in claim 7, wherein a self-clean valve is arranged in an opening in the bottom wall of the water tank and connected to a self-clean knob arranged in a top wall of the water tank and in line with said self-clean valve whereby when the self-clean knob is actuated, the self-clean valve opens and an effective amount of cold water flows into the steam chamber onto a hot bottom wall of the steam chamber to effect cleaning thereof.

* * * * *